US005385127A

United States Patent [19]

Karas et al.

[11] Patent Number: 5,385,127

[45] Date of Patent: Jan. 31, 1995

[54] SURROUND INJECTION POINT FOR DIESEL ENGINE

[75] Inventors: Miroslav A. Karas, 848 68th St., Brooklyn, N.Y. 11220; George Spector, New York, N.Y.

[73] Assignee: Miroslav A. Karas

[21] Appl. No.: 185,200

[22] Filed: Jan. 24, 1994

[51] Int. Cl.[6] ..... F02B 3/00

[52] U.S. Cl. ..... 123/299; 123/305

[58] Field of Search ..... 123/305, 299

[56] References Cited

U.S. PATENT DOCUMENTS

| | | | |
|---|---|---|---|
| 1,464,268 | 8/1923 | Keller | 123/299 |
| 2,107,792 | 2/1938 | Huesby | 123/299 |
| 2,173,081 | 9/1939 | Barkeij | 123/299 |
| 2,606,538 | 8/1952 | Malin | 123/299 |
| 4,612,898 | 9/1986 | Steiger et al. | 123/299 |
| 4,977,875 | 12/1990 | Kumagai et al. | 123/299 |
| 5,249,557 | 10/1993 | Katoh et al. | 123/305 |

*Primary Examiner*—Willis R. Wolfe
*Assistant Examiner*—Erick Solis

[57] ABSTRACT

An improved fuel injection system is provided for a diesel engine that will increase the RPM of the engine, by using a plurality of angularly positioned injection holes about the circumference between a fuel chamber and a combustion chamber in a cylinder head. A spring biased ring valve in the fuel chamber will move up by pressure of fuel coming from a fuel pump, so as to open all of the injection holes simultaneously causing an agitated motion of the fuel, when entering the combustion chamber for better combustion of the fuel.

4 Claims, 1 Drawing Sheet

SURROUND INJECTION POINT FOR DIESEL ENGINE

BACKGROUND OF THE INVENTION

The instant invention relates generally to engine fuel supply systems and more specifically it relates to an improved fuel injection system for a diesel engine, which provides a structure that will increase the RPM of the engine, by forcing the fuel into the combustion chamber to make the engine more efficient. There are available various conventional engine fuel supply systems which do not provide the novel improvements of the invention herein disclosed.

SUMMARY OF THE INVENTION

A primary object of the present invention is to provide an improved fuel injection system for a diesel engine that will overcome the shortcomings of the prior art devices.

Another object is to provide an improved fuel injection system for a diesel engine that will increse the RPM of the engine by using a plurality of fuel injection holes about the circumference of the combustion chamber and a high pressure fuel pump to force in the fuel, thereby making the engine more efficient.

An additional object is to provide an improved fuel injection system for a diesel engine that utilizes a spring biased ring valve which will move up by the pressure of the fuel coming from the fuel pump, so as to open all of the injection holes simultaneously which are angularly positioned thereabout, causing an agitated motion of the fuel when entering the combustion chamber.

A further object is to provide an improved fuel injection system for a diesel engine that is simple and easy to use.

A still further object is to provide an improved fuel injection system for a diesel engine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
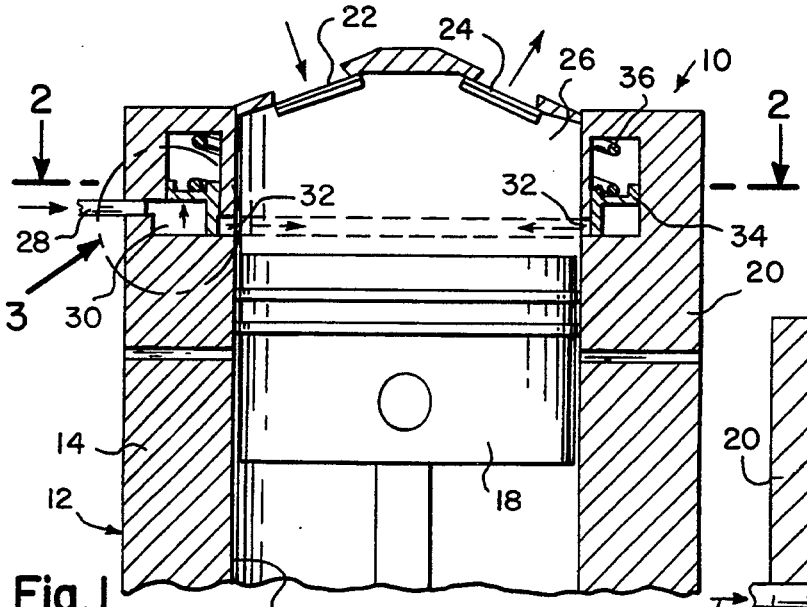
FIG. 1 is a diagrammatic sectional view of the instant invention.
Figure 2:
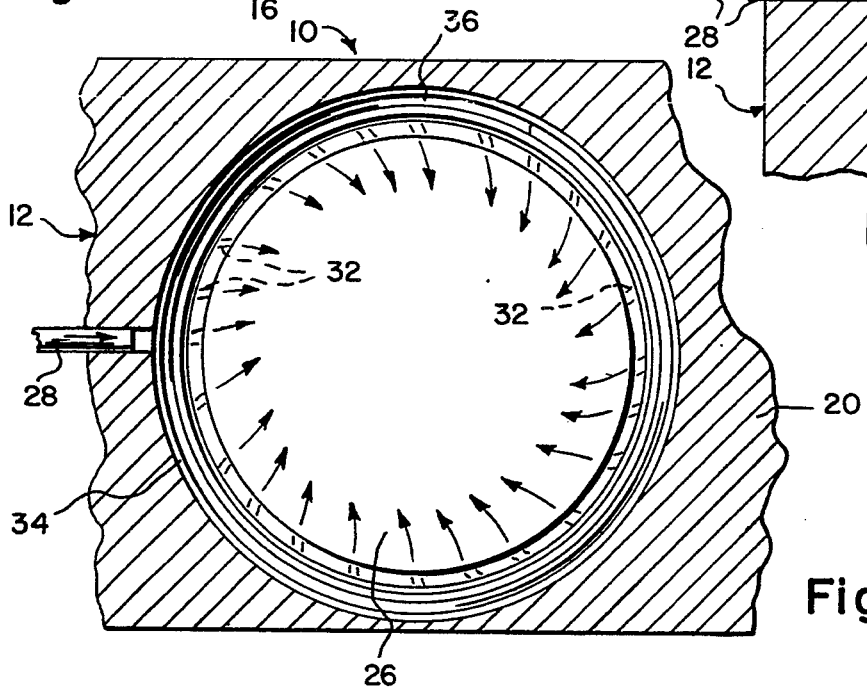
FIG. 2 is a diagrammatic cross sectional view generally taken along line 2—2 in FIG. 1.

Turning now descriptively to the drawings, in which similar reference characters denote similar elements throughout the several views, FIGS. 1 and 2 illustrate an improved fuel injection system 10 for a diesel engine 12 having a cylinder block 14 with a cylinder 16 therein for a piston 18 to ride up and down, a cylinder head 20 thereon with an air inlet valve 22 and an exhaust outlet valve 24 above a combustion chamber 26 and a fuel line 28 connected to an annular fuel chamber 30. The system 10 consists of the cylinder head 20 having a plurality of angularly positioned small injection holes 32 between the fuel chamber 30 and the combustion chamber 26. A ring valve 34 is within the fuel chamber 30 to move up and down therein. A spring 36 is within the fuel chamber 30 to normally bias the ring valve 34 down to close off the injection holes 32. When the fuel is forced through the fuel line 28 by a high pressure fuel pump, the ring valve 34 will move up to overcome the spring 36 when the fuel pressure in the fuel chamber 30 reaches a predetermined pressure force, simultaneously opening all of the injection holes 32. This will cause an agitated motion of the fuel, when entering the combustion chamber 26 for a better combustion of the fuel, thereby increasing the RPM of the engine 12 and making the engine more efficient.

Figure 3:
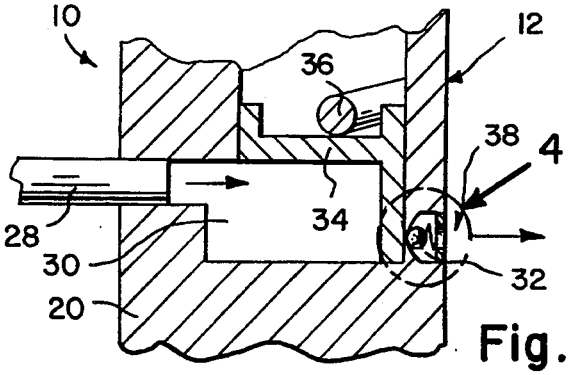
FIG. 3 is an enlarged cross sectional view as indicated by arrow 3 in FIG. 1, showing another modification with one of a plurality of ball check valves for preventing return outward flow of gas from the combustion chamber.

As shown in FIG. 3, the improved fuel injection system 10 can further include a plurality of check valves 38. Each check valve 38 is mounted within each injection holes 32, for preventing return outward flow of gases produced in the combustion chamber 26, after the combustion of the fuel is completed.

Figure 4:
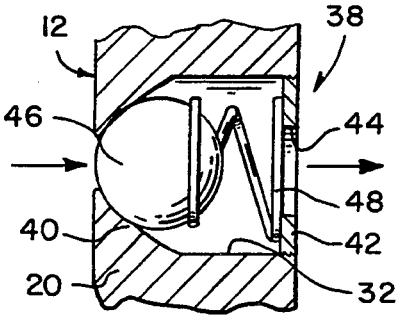
FIG. 4 is an enlarged cross sectional view as indicated by arrow 4 in FIG. 3, showing one of the ball check valves in greater detail.

Each check valve 38, as shown in FIG. 4, includes a seat 40 formed on an inner end of the injection hole 32. A disc 42 having a central aperture 44 is mounted into an outer end of the injection holes 32. A ball 46 is within the injection holes 32 adjacent the seat 40. A spring 48 is between the disc 42 and the ball 46 within the injection holes 32, to normally bias the ball 46 against the seat 40. When the fuel pressure within the fuel chamber 30 reaches the predetermined pressure force to move up the ring valve 34, the ball 46 will then move away from the seat 40 allowing the fuel to enter the combustion chamber 26.

Figure 1A:
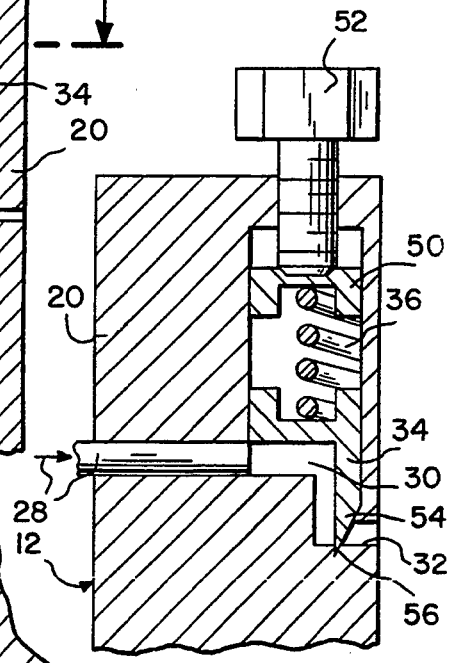
FIG. 1A is a cross sectional view of a portion of the invention showing a modification of the valve mechanism between the fuel and combustion chambers.

FIG. 1A shows a ring tightener 50 to sit upon the spring 36 within the fuel chamber 30. A plurality of spaced apart set screws 52 are threaded into the cylinder head 20 to engage with the ring tightener 50, to regulate the force of the spring 36 on the ring valve 34. The ring valve 34 has a tapered annular bottom edge 54, to fit into an annular notch 56 about the injection holes 32, to make a better separation between the fuel chamber 30 and the combustion chamber 26 in the cylinder head 20.

OPERATION OF THE INVENTION

A high pressure pump forces fuel through the fuel line 28 into the fuel chamber 30 in the cylinder head 20. The ring valve 34 will move up to overcome the spring 36 when pressure increases, opening all of the injection holes 32 around the combustion chamber 26. The angular position of the injection holes 32 will cause an agitation motion of the fuel in the combustion chamber 26. The amount of fuel that is forced through each injection hole 32 is relatively small, which causes a faster and better mixture for improved combustion. The pressure in the fuel chamber 30 will decrease rapidly, allowing the spring 36 to push the ring valve 34 down closing off every injection hole 32.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved fuel injection system for a diesel engine having a cylinder block with a cylinder therein for a piston to ride up and down, a cylinder head thereon with an air inlet valve and an exhaust outlet valve above a combustion chamber and a fuel line connected to an annular fuel chamber, said system comprising:

a) the cylinder head having a plurality of angularly positioned small injection holes between the fuel chamber and the combustion chamber;

b) a ring valve within the fuel chamber to move up and down therein; and c) a spring within the fuel chamber to normally bias said ring valve down to close off said injection holes, so that when the fuel is forced through the fuel line by a high pressure fuel pump said ring valve will move up to overcome said spring, when the fuel pressure in the fuel chamber reaches a predetermined pressure force, simultaneously opening all of said injection holes causing an agitated motion of the fuel when entering the combustion chamber for a better combustion of the fuel, thereby increasing the RPM of the engine and making the engine more efficient.

2. An improved fuel injection system as recited in claim 1, further including a plurality of check valves, each mounted within each said injection hole for preventing return outward flow of gases produced in the combustion chamber after the combustion of the fuel is completed.

3. An improved fuel injection system as recited in claim 2, wherein each said check valve includes:

a) a seat formed on an inner end of said injection hole;

b) a disc having a central aperture mounted into an outer end of said injection hole;

c) a ball within said injection hole adjacent said seat; and d) a spring between said disc and said ball within said injection hole to normally bias said ball against said seat, so that when the fuel pressure within the fuel chamber reaches the predetermined pressure force to move up said ring valve, said ball will then move away from said seat allowing the fuel to enter the combustion chamber.

4. An improved fuel injection system as recited in claim 1, further including:

a) a ring tightener to sit upon said spring within the fuel chamber;

b) a plurality of spaced apart set screws threaded into the cylinder head to engage with said ring tightener to regulate the force of said spring on said ring valve; and c) said ring valve having a tapered annular bottom edge to fit into an annular notch about said injection holes, to make a better separation between the fuel chamber and the combustion chamber in the cylinder head.

* * * * *